United States Patent [19]

Fehlhaber et al.

[11] 4,145,820

[45] Mar. 27, 1979

[54] MOISTURE REMOVER FOR PRODUCE

[75] Inventors: Gustav J. Fehlhaber, Burlingame; Victor J. Dervin, Cupertino, both of Calif.

[73] Assignee: NPI Corporation, Burlingame, Calif.

[21] Appl. No.: 823,393

[22] Filed: Aug. 10, 1977

[51] Int. Cl.[2] ..... F26B 21/06

[52] U.S. Cl. ..... 34/75

[58] Field of Search ..... 34/73, 75, 77, 212, 34/225, 78; 55/257 HE, 269, 385 R

[56] References Cited

U.S. PATENT DOCUMENTS

| | | | |
|---|---|---|---|
| 596,827 | 1/1898 | Quinn | 34/78 |
| 747,788 | 12/1903 | Smith | 34/212 X |
| 1,132,020 | 3/1915 | Luther | 34/78 |
| 1,144,817 | 6/1915 | Dale | 34/75 X |
| 1,756,992 | 5/1930 | Quiggle | 34/75 X |
| 2,064,084 | 12/1936 | Sando | 34/77 |

*Primary Examiner*—Carlton R. Croyle
*Assistant Examiner*—Leonard E. Smith
*Attorney, Agent, or Firm*—Lothrop & West

[57] ABSTRACT

A moisture remover for produce is preferably installed in an enclosure within which a produce support such as a foraminous conveyor is installed. A fan takes heated air from a heater and discharges the heated air upwardly through the conveyor and then through the produce itself. Air leaving the produce returns to the air heater for reheating and recirculation by the fan. Moisture from the produce rises and travels to a cooler within the enclosure and condenses on the cooler. There is no air circulation through the cooler. Moisture condensed on the cooler is drained from the cooler and preferably is discharged outside the enclosure and is not reevaporated into the recirculating heated air.

3 Claims, 1 Drawing Figure

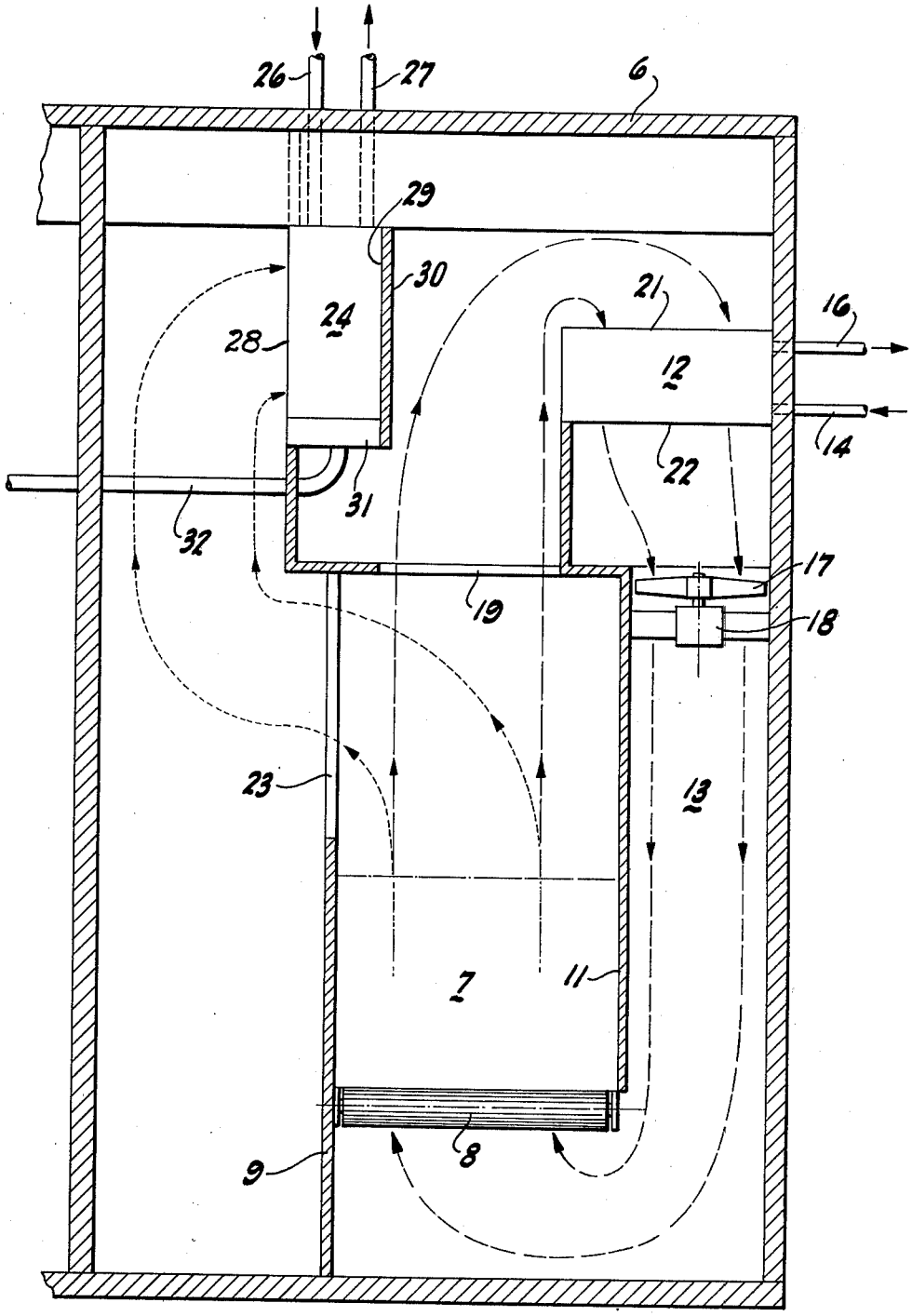
26
27
6
29
30
24
28
21
16
12
14
22
31
32
17
19
18
23
13
7
11
9
8

MOISTURE REMOVER FOR PRODUCE

BRIEF SUMMARY OF THE INVENTION

Various products such as field produce, some nuts and the like as they are harvested are not sufficiently dry for further handling, for storage or for distribution in commerce and require moisture to be removed therefrom. In some instances this is simply moisture which coats the produce and in other instances is moisture within the produce itself, but in both instances there is a need for a drier product. The saving of drying energy is of increasing importance, so that many heretofore utilized drying devices, generally utilizing a great deal of heating, are no longer economical even if sufficient heat energy for drying is available.

It is of interest to provide a mechanism for drying produce effective to remove the desired quantities of moisture therefrom and to do so in an energy saving, thermally efficient and effective fashion. This is done by circulating heated air through the body of the produce and by providing a cooling device such as a coil on which moisture discharged from the produce is condensed. The condensed liquid is drained away from the cooler and so removed from the circulating air, which can be reheated and reused. There is a substantial reduction in energy consumption, the reduction being of the order of 10% to 25% over heretofore utilized mechanisms. Under present drying arrangements; for example, in connection with grain, sufficient heat is supplied to an air current to evaporate the moisture or water. Also, the air current is used as a carrier to get the moisture away from the produce. The heated, drying air is dissipated with the moisture. Reheating must commence with atmospheric air or previously unheated air. With the present arrangement, the moisture is extracted from the circulating air by a cooling mechanism, so that the remaining, relatively dry, still warm air needs only to be partially reheated in order to drive off additional moisture from the produce. The removed moisture is not carried to waste by a warm air current, but rather is drained from the cooler and is conducted away from the operation.

BRIEF DESCRIPTION OF THE SEVERAL VIEWS OF THE DRAWING

The drawing is a diagram showing schematically the moisture remover for produce of the invention, the view being generally a cross-section on a vertical plane through an enclosure including the various components of the remover.

DETAILED DESCRIPTION

While the moisture remover for produce can be utilized with a wide range of items, it is for example, disclosed herein as it has been utilized for the drying of pistachio nuts. A representative device for this purpose includes an enclosure 6 having a floor, walls and ceiling in the customary way and being provided with a suitable support for a body 7 of produce, such as pistachio nuts, that have been hulled. The body of produce is preferably brought into the enclosure 6 and is carried by a conveyor 8 extending from and to the outside of the compartment for loading and unloading. Preferably, the conveyor is fabricated of a foraminous or openwork material, so that while the lading is appropriately supported for conveyance into and out of the compartment, nevertheless there can easily be air flow through the body of produce, particularly through the conveyor 8 upwardly and in a generally uniform fashion. Flow is between the bottom and the open-top body of produce supported at the sides by first partition 9 and a second partition 11 forming at least partial divisions of the enclosure.

At a convenient location within the enclosure 6, there is provided an air heater 12 disposed at the head of a downflow conduit 13 generally enclosed between an outer side wall of the enclosure and the partition 11. The heater 12 can receive its heat energy from any suitable source. Since this mechanism is usually operated in connection with a refrigeration plant, and since the refrigeration condenser usually serves as a heat dissipater, it is convenient to take hot condenser cooling liquid and introduce it through an intake duct 14 into the air heater 12 and return the somewhat cooled circulating liquid through a return duct 16 extending back to the condenser. In this way otherwise waste heat is utilized as a suitable supply of energy for the heater 12.

From the heater air flows downwardly under the influence of a circulating fan 17 having a drive motor 18 and supported within the conduit 13. The downward flow of warm air continues to the bottom of the enclosure and then flows upwardly from below the conveyor 8 and evenly through the body of produce on the conveyor. The produce 7 changes from time to time as the conveyor 8 advances during the drying process. Warm air flowing upwardly through the body 7 tends to rise upwardly through an opening 19 in the top of the partition 11 and travels directly to the inlet side 21 of the heater 12 for reheating. The newly heated air discharges from the outlet side 22 of the heater 12 and then is recirculated through and by the fan 17.

In contradistinction to some previous practices, the opening 19 is not an outlet for moisture laden, somewhat cooled air discharged from the produce body 7. Rather, there is likewise an opening 23 in the partition 9 affording a somewhat indirect or circuitous flow path toward a cooler 24. The refrigeration plant, previously mentioned, for the cooler 24 supplies cold refrigerant through an inlet pipe 26 and establishes a relatively low temperature in the cooler 24, the return being through an outlet pipe 27.

Since the vicinity of the entrance 28 to the cooler 24 is at a relatively low temperature, there is a gradient due to differences in vapor pressure between the top of the produce body 7 and the cooler. Thus, moisture discharged from the body 7 travels through the opening 23 and into the inlet 28 of the cooler 24. This moisture, due to the much lower temperature in the cooler 24, deposits in the cooler in liquid form. The moisture does not flow through the cooler 24 and does not flow therethrough toward the fan 17. This is because the outlet 29 of the cooler is not open, but is closed by a wall 30, thus precluding any air flow through the cooler. The moisture that deposits on the cooler drains by gravity into a collector pan 31 and also flows by gravity from the pan out through a duct 32, preferably to the outside of the enclosure 6, so that the removed moisture cannot reevaporate and reenter the warmed air.

In this fashion much of the moisture from the produce 7 is in effect precipitated out of the environs by reason of the cooler 24 and is carried away.

The extracted moisture, in large measure having gone to the cooler through the opening 23, does not travel through the opening 19 back to the heater 12. Air which does travel back through the opening 19 to the heater 12 is relatively dry air and has little moisture that has to be reevaporated by the heater 12. This results in an energy saving. Furthermore, since the air itself is not discharged to the atmosphere as a vehicle for carrying away moisture, the air still retains some of its previous heat and is simply reheated to an appropriate high temperature and then is again circulated through the fan as before. This also saves energy.

In this fashion there is afforded sufficient precipitation of moisture from the produce and by the cooler 24 so that the moisture can flow out of the system by gravity and can leave behind warmed, relatively dry air for recirculation. The produce is deprived of moisture to any desired reasonable extent, and the energy saving by reason of this construction is substantial, not only because the compressor is utilized not only for refrigeration but also for heating, but particularly because the removed moisture is taken from the system in liquid form simply by gravity.

We claim:

1. A moisture remover for produce comprising an enclosure having a floor and a ceiling and having a first side wall and a second side wall extending vertically and spaced horizontally apart, a first vertical partition extending from said floor to said ceiling and together with said first side wall defining a cooling chamber, a second vertical partition extending from a lower level above said floor to an upper level below said ceiling and with said first partition defining an upflow conduit and with said second side wall defining a downflow conduit, means for supporting a body of produce containing moisture with portions of said body exposed for flow of air therethrough and extending across said upflow conduit about at said lower level, a fan in said enclosure and effective to move air in a circuit from a location under said produce supporting means upwardly through said produce supporting means and through said upflow conduit and then into and downwardly through said downflow conduit and then back to said location under said produce supporting means, an air heater having an inlet and an outlet within said enclosure and in said circuit, means defining an opening in said first partition between said upflow conduit and said cooling chamber, a cooler having an inlet and an outlet, said cooler being disposed in said enclosure with said cooler inlet open to said cooling chamber in position for receiving moisture from said body of produce on said support and traveling therefrom into said upflow conduit and through said opening into said cooling chamber and to said cooler inlet, and means for precluding air flow through said cooler outlet.

2. A device as in claim 1 in which said supporting means is an air-pervious conveyor.

3. A device as in claim 1 in which air flows to said heater inlet in a substantially direct path and moisture flows to said cooler inlet in a substantially indirect path.

* * * * *